US006850004B2

(12) United States Patent
Yoneda et al.

(10) Patent No.: US 6,850,004 B2
(45) Date of Patent: Feb. 1, 2005

(54) EL COMPOSITE STRUCTURE

(75) Inventors: Koji Yoneda, Narashino (JP); Atsushi Saito, Narashino (JP); Yasufumi Naoi, Narashino (JP)

(73) Assignee: Seiko Precision Inc., Chiba-ken (JP)

( * ) Notice: Subject to any disclaimer, the term of this patent is extended or adjusted under 35 U.S.C. 154(b) by 0 days.

(21) Appl. No.: 10/243,346

(22) Filed: Sep. 12, 2002

(65) Prior Publication Data

US 2003/0052598 A1 Mar. 20, 2003

(30) Foreign Application Priority Data

Sep. 18, 2001 (JP) ..... 2001-283898
Aug. 19, 2002 (JP) ..... 2002-237997

(51) Int. Cl.[7] ..... H05B 33/06
(52) U.S. Cl. ..... 313/506; 313/512
(58) Field of Search ..... 313/506, 498, 313/510, 512, 306; 362/84, 24, 85, 88, 368; 368/84, 242; 428/917

(56) References Cited

U.S. PATENT DOCUMENTS 5,702,565 A 12/1997 Wu et al. ..... 156/643.1
6,091,194 A * 7/2000 Swirbel et al. ..... 313/498
6,201,346 B1 * 3/2001 Kusaka ..... 313/504
6,448,710 B1 * 9/2002 Asai et al. ..... 313/504
6,500,295 B1 * 12/2002 Kubota ..... 156/269
2003/0075825 A1 * 4/2003 Yoneda et al. ..... 264/272.11

FOREIGN PATENT DOCUMENTS

| | | |
|---|---|---|
| EP | 0 306 296 | 3/1989 |
| EP | 0 758 836 | 2/1997 |
| JP | 2000-068051 | 3/2000 |
| JP | 2000-173780 | 6/2000 |
| WO | 98/49871 | 11/1998 |

OTHER PUBLICATIONS

Keiji Nunomura et al: "TFEL Character Module Using a Multilayer Ceramic Substrate" Proceedings of the side, Society for Information Display, Playa Del Rey, CA, US, vol. 28, No. 4, 1987, pp. 351–355, XP 000007294 –the whole document.

* cited by examiner

*Primary Examiner*—Ashok Patel
(74) *Attorney, Agent, or Firm*—Jordan and Hamburg LLP

(57) ABSTRACT

A surface of a substrate which is an outer packaging case is integrated with a decorative film and an EL device. An upper case of the outer packaging case has through-holes through which a transparent electrode layer and a back electrode layer that constitute the EL device are exposed. Contact pins are elastically contacted with the transparent electrode layer and the back electrode layer via the through-holes, and the electrodes are thereby connected to an EL-driving circuit.

6 Claims, 2 Drawing Sheets

EL COMPOSITE STRUCTURE

BACKGROUND

The present invention relates to an EL composite structure for use in mobile phones, etc.

In situations where an outer packaging case of an EL device is made to have a lighting function, one general technique heretofore employed in the art is as follows: An EL device is disposed on a back surface of an outer packaging case thereof, and for connecting an EL-driving circuit to the EL device, an auxiliary electrode of FPC or the like is connected to the EL device and the electrode is led out of the edge of the outer packaging case, or the EL electrode is directly extended to the edge of the outer packaging case and led out of it to thereby connect the EL device with an EL-driving circuit.

In that constitution, however, a shaped resin is exposed out of the surface of the outer packing case and the appearance of the case is not good. Therefore, the surface of the case must be painted or must be covered with a decorative film, and it requires superfluous steps and superfluous members. In addition, when the electrode is led out of the edge of the outer packaging case, it must be folded so as not to interfere with the bonding of the case to the other outer packaging case on the opposite side. However, when the electrode is folded, it receives stress and is often cut, therefore detracting from the quality stability of the constitution.

SUMMARY OF THE INVENTION

Given the above noted state of the art, the present invention is to ensure easy connection of an EL device to an EL-driving circuit, not requiring any superfluous steps or members and not having a risk of damaging electrodes, and to ensure stable quality of the connected structure.

A first characteristic feature of the EL composite structure of the invention is that an EL device therein is integrated with a surface of a substrate thereof, the substrate is processed to have through-holes through which a transparent electrode layer or an auxiliary electrode provided on the transparent electrode layer and a back electrode layer that constitute the EL device are partly exposed, and the transparent electrode layer or the auxiliary electrode and the back electrode layer are electrically connected with an EL-driving circuit via the through-holes therein. Having the aforesaid constitution, the electrodes of the EL composite structure are readily connected with an EL-driving circuit with no risk of damaging them.

A second characteristic feature of the EL composite structure is that the EL device therein is integrated with the surface of the substrate thereof, the substrate is processed to have through-holes through which the transparent electrode layer or the auxiliary electrode provided on the transparent electrode layer and the back electrode layer that constitute the EL device are partly exposed, contact pins provided in the EL-driving circuit therein are elastically contacted with the transparent electrode layer or the auxiliary electrode and the back electrode layer via the through-holes so that the transparent electrode layer or the auxiliary electrode and the back electrode layer are electrically connected with the EL-driving circuit, and a protective plate is provided on the outer surface of the substrate opposite to the EL device and corresponding to the contact pins. The protective plate may be transparent, serving also as a decorative plate.

Preferably, the substrate may be integrated with a decorative film formed thereon opposite to the EL device. Also preferably, the substrate is integrated with the EL device through insert molding, or is integrated with the EL device and the decorative film through insert molding. Also preferably, the substrate is an outer packaging case.

DETAILED DESCRIPTION

Figure 1:
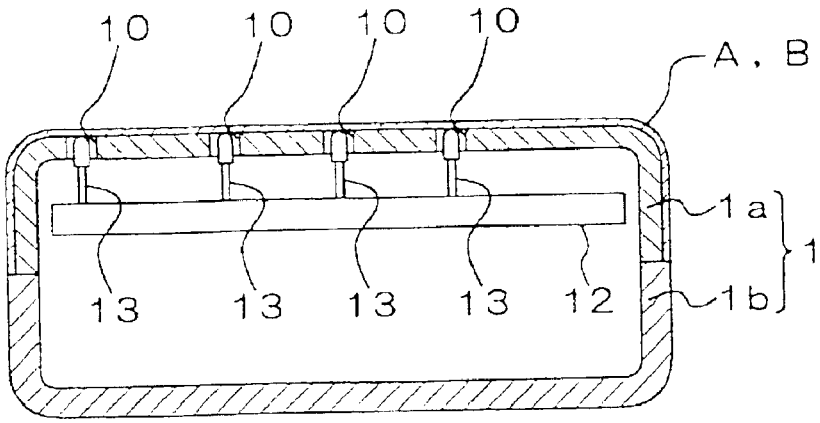
FIG. 1 is a cross-sectional view showing one embodiment of the invention.

One embodiment of the invention is described with reference to the drawings attached hereto. FIG. 1 shows a cross section of one embodiment of the invention in which a substrate is an outer packaging case 1 of a mobile phone for example. In the illustrated embodiment, the outer packaging case 1 is composed of an upper case 1*a* and a lower case 1*b* of which edges of openings are butt-joined to each other in any ordinary manner, for example, with screws (not shown) or by snapping them shut to constitute the substrate, outer packaging case 1.

Figure 2:
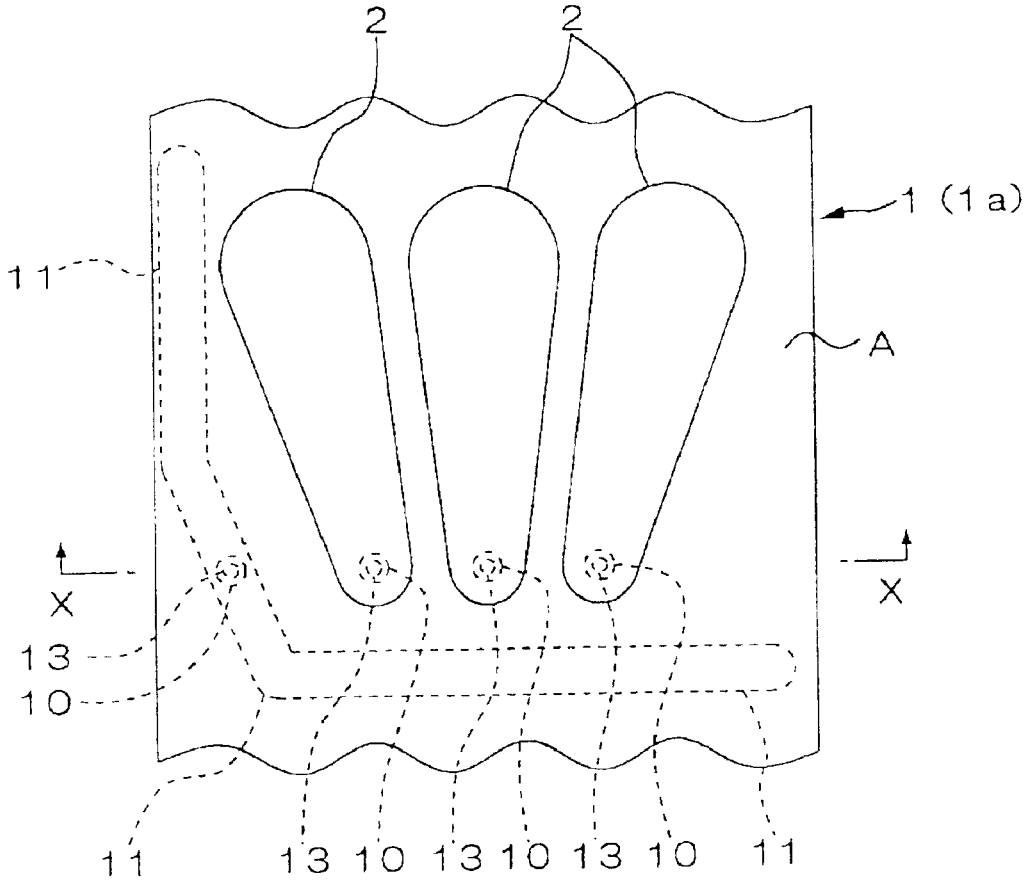
FIG. 2 is a plan view showing a part of the front surface of FIG. 1.

FIG. 2 shows a part of a front surface of the upper case 1*a*, including a lighting area 2. The lighting area 2 is not limited only to a flat part of the front surface of the upper case 1*a* as in the illustrated case, but may be folded from the front surface of the upper case 1*a* to a side surface thereof. In the light area 2, used is an EL device, and its detailed constitution is shown in FIG. 3.

Figure 3:
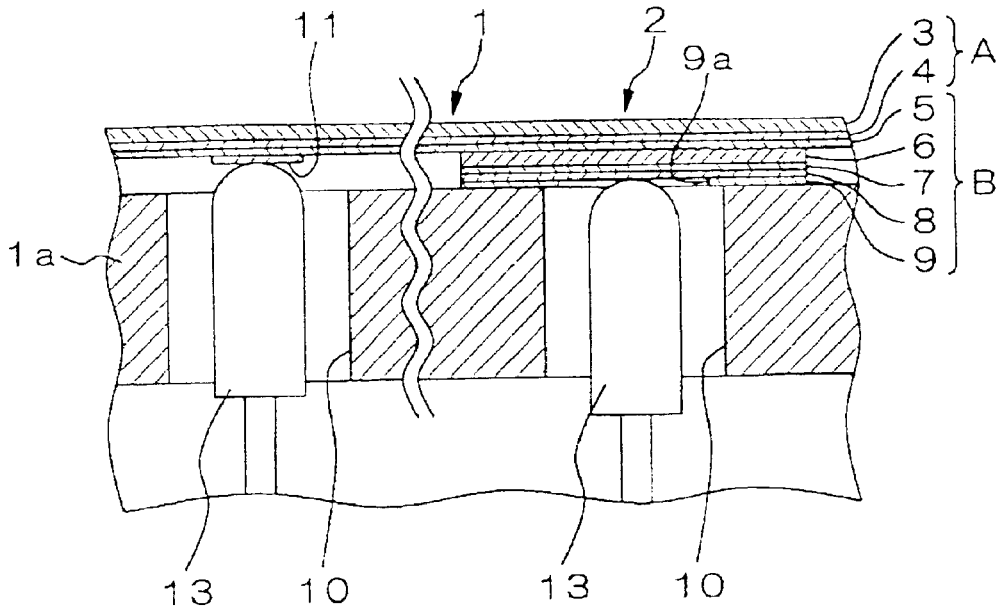
FIG. 3 is an enlarged X—X cross-sectional view of FIG. 2.

As in FIG. 3, the surface of the upper case 1*a* is integrated with a decorative film A and an EL device B. The decorative film A comprises a transparent film 3 of a polymer alloy (PC/PBT) of polycarbonate (PC) and polybutylene terephthalate (PBT), having a thickness of about 175 mm, and a decorative layer 4 with patterns, figures, letters and the like formed thereon.

On the decorative layer 4, formed is the EL device B. One embodiment of the EL device B is described. An electrode film of indium-tin oxide (ITO) is formed on a transparent film of polycarbonate (PC) to give a transparent electrode layer 5, and this is provided on the entire surface of the decorative layer 4. Luminous ink is printed on the transparent electrode layer 5 in the area thereof corresponding to the above-mentioned lighting area 2 to form a luminous layer 6. For the luminous element in the luminous ink, used is Cu-doped zinc sulfide (ZnS). The luminous element is mixed with a fluororesin binder that is prepared by dissolving a vinylidene fluoride-propylene hexafluoride in a solvent of methyl ethyl ketone, and this is stirred to prepare the luminous ink. The luminous ink is printed on the transparent electrode layer 5 in a mode of, for example, screen printing, and then dried under heat to form the luminous layer 6.

A ferroelectric layer 7 is formed on the luminous layer 6 also through printing in the same manner as above. The insulating ink to form the ferroelectric layer 7 is prepared by mixing and stirring a ferroelectric substance of barium titanate (BaTiO3) and the fluororesin binder as above. Carbon ink is printed on the ferroelectric layer 7, and dried under heat to form a back electrode layer 8. Alternatively, the back electrode layer 8 may also be formed of carbon powder, silver powder and copper powder in a polyester binder. On the back electrode layer 8, formed is a protective layer 9. The protective layer 9 may be made of an electrically-insulating material of, for example, polyester, acrylic resin or polyvinyl chloride (PVC). Polyester is a generic term for various types of materials, concretely including polyethylene terephthalate (PEI), polybutylene terephthalate (PBT), etc. The same shall apply to acrylic resin, and its one specific example is polymethyl methacrylate resin (PMMA). The protective layer 9 has a hole 9*a* through which a part of the back electrode layer 8 of every lighting area 2 is exposed out.

On the transparent electrode layer 5, formed is a layer of an auxiliary electrode 11 in the area in which each EL device B that corresponds to the lighting area 2 is not formed. The auxiliary electrode 11 is formed through printing with carbon ink thereon. The auxiliary electrode 11 electrically communicates with the transparent electrode layer 5, and it acts to surely connect the transparent electrode layer 5 of a broad area to a power source.

The decorative film A and the EL device B that are integrated with each other in the manner as above undergoes plastic deformation in accordance with the shape of the upper case 1*a* as in FIG. 1. These are inserted into the cavity of a mold for injection-molding (not shown), and resin is injected into the cavity to thereby integrate the upper case 1*a* with the decorative film A and the EL device B. In the injection-molding mold, pins are formed on the inner wall of the cavity, which are for forming the through-holes 10 in the upper case 1*a*. The through-holes 10 are formed in the site opposite to the hole 9*a* and in the site that may be opposite to a part of the auxiliary electrode 11. The resin material to be used for the insert molding is preferably the same material as that of the transparent electrode layer or the protective layer, or a polymer alloy that contains the same material, or a material having a high melting point, so as to enhance the bonding of the protective layer 9 and the transparent electrode layer 5 thereto.

As in FIG. 1, a circuit board 12 that includes an EL-driving circuit is fixed inside the lower case 1*b*, and contact pins 13 that may be elastically connected to each electrode layer of the EL device B are stood on the circuit board 12. The contact pins 13 are so constituted that their tips are elastically pressed by springs or the like (not shown) in the direction in which they are elastically connected to each electrode layer of the EL device B. The contact pins 13 are so provided that they may pass through the corresponding through-holes 10 of the upper case 1*a*. In the closed condition in which the upper case 1*a* and the lower case 1*b* are joined together, the tip of each contact pin 13 is elastically contacted with the auxiliary electrode 11 and with each back electrode layer 8 in each lighting area 2 by the pressing force of springs or the like (not shown). In place of the contact pins, also usable herein are coil springs, flat springs or the like.

Having the constitution as above, when the upper case 1*a* and the lower case 1*b* are joined together, then the contact pins 13 pass through the corresponding through-holes 10 of the upper case 1*a* and their tips are elastically contacted with the auxiliary electrode 11 and the back electrode layer 8 at a suitable elastic force. In that condition, the EL-driving circuit of the circuit board 12 is connected with each electrode layer of the EL device B via the contact pins 13. Accordingly, the EL device B is put on and driven to light up the lighting area 2, and, as a result, the front surface of the upper case 1*a* is beautifully lit up via the decorative film A.

Next described is another embodiment of the invention. As in FIG. 3, the thickness of the EL device B that includes the back electrode layer 8 to which the contact pins 13 are elastically contacted, and the decorative film A is from 0.2 to 1.0 mm or so. Therefore, there is a probability that the surface of the lighting area 2 of the outer packaging case 1 will be deformed with the lapse of time by the elastic pressure of the contact pins 13 applied thereto. In addition, if the outer packaging case 1 of a mobile phone is dropped down by accident and if, in such a case, the contact pins have been worn in long-term use, the worn tips of the contact pins 13 will break the EL device B and the decorative film A owing to the external force of the shock, and will be exposed. In that case, the users will be in danger of getting an electric shock or having a wound.

Figure 4:
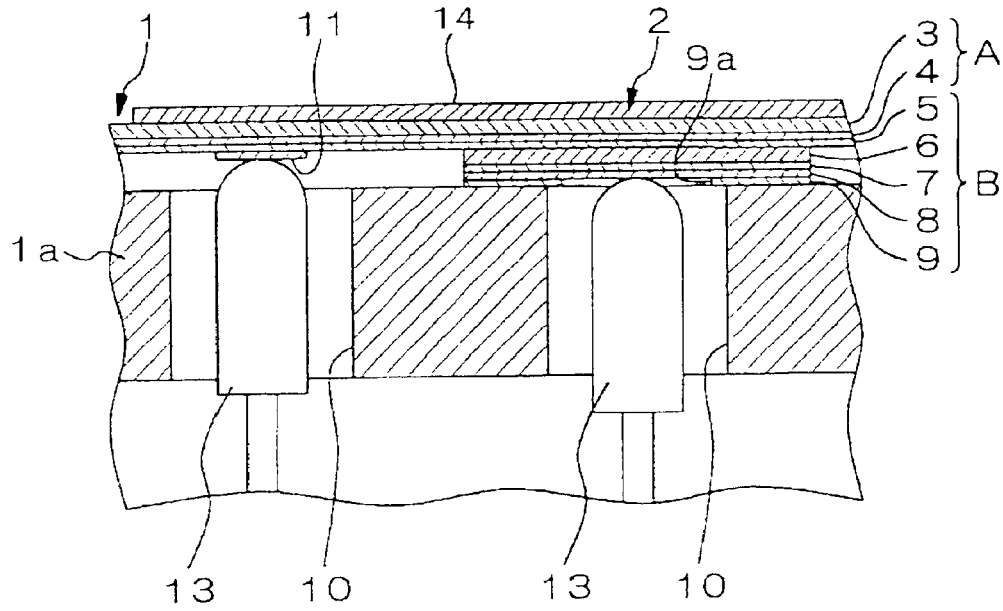
FIG. 4 is a cross-sectional view of another embodiment of the invention.

As shown in FIG. 4 to evade the trouble, a protective plate 14 is provided on the surface of the lighting area 2 of the outer packaging case 1. The protective plate 14 is stuck to the outer packaging case 1 with a double-coated adhesive tape or with an adhesive, and its strength is enough to prevent the lighting area 2 from being deformed by the contact pins 13 and to prevent the EL device B and the decorative film A from being broken. Preferably, the protective plate 14 serves also as a decorative plate in view of the external design of the structure. More preferably, the protective plate 14 is transparent so as not to reduce the lighting function of the device.

As the case may be, the outer packaging case 1 is not formed through insert molding but may be integrated with the EL device B that has been separately formed, using an adhesive or the like. In the embodiments illustrated hereinabove, the upper case 1*a* and the lower case 1*b* are joined together to thereby connect the electrode layers to the EL-driving circuit, to which, however, the invention is not limited. Apart from the illustrated embodiments, the circuit board 12 may be screwed to the upper case 1*a* so as to connect the electrode layers to the EL-driving circuit.

In the illustrated embodiments, a layer of the auxiliary electrode 11 is formed on the transparent electrode 5, and the contact pin 13 is made to elastically contact with the auxiliary electrode 11. If desired, the auxiliary electrode 11 may be omitted, and the contact pins 13 may be directly elastically contacted with the transparent electrode layer 5 via the through-holes 10.

In the EL composite structure of the invention, the transparent electrode layer or the auxiliary electrode formed on the transparent electrode layer and the back electrode layer of the EL device are connected to the EL-driving circuit via the through-holes formed in the substrate. In this, therefore, it is unnecessary to lead the electrodes out of the edge of the substrate, and the risk of damaging the electrodes is evaded. Accordingly, the quality of the EL composite structure of the invention is all the time stabilized. In addition, in this, the electrodes can be readily connected to the EL-driving circuit and the structure is simplified. Further, the substrate can be readily formed through insert molding.

Moreover, in the EL composite structure of the invention, the contact pins are elastically contacted with the transparent electrode layer or the auxiliary electrode formed on the transparent electrode layer and with the back electrode layer via the through-holes formed in the substrate, the transparent electrode layer or the auxiliary electrode formed on the transparent electrode layer and the back electrode layer are electrically connected with the EL-driving circuit, and a protective plate is formed on the outer surface of the substrate opposite to the EL device and corresponding to the contact pins. In this, therefore, the outer shape of the substrate is not deformed, and even though it is dropped down, the contact pins are not exposed out by the external force of the shock. Accordingly, the structure of the invention is free from a danger of getting an electric shock or having a wound, and is safe.

What we claim is:

1. An EL composite structure, which comprises:

an EL device is integrated with the surface of a substrate, the substrate is processed to have through-holes through which a transparent electrode layer or an auxiliary electrode provided on the transparent electrode layer and a back electrode layer that constitute the EL device are partly exposed out, contact pins provided in an EL-driving circuit are elastically contacted with the transparent electrode layer or the auxiliary electrode and the back electrode layer via the through-holes so that the transparent electrode layer or the auxiliary electrode and the back electrode layer are electrically connected with the EL-driving circuit, and a protective plate is provided on a surface of the EL device opposite to the contact pins.

2. The EL composite structure as claimed in claim 1, wherein the substrate is integrated with a decorative film formed thereon opposite to the EL device.

3. The EL composite structure as claimed in claim 2, wherein the substrate is integrated with the decorative film and the EL device through insert molding.

4. The EL composite structure as claimed in claim 1, wherein the substrate is an outer packaging case.

5. The EL composite structure as claimed in claim 1, wherein the protective plate serves also as a decorative plate.

6. The EL composite structure as claimed in claim 1, wherein the protective plate is transparent.

* * * * *